US008357010B2

(12) United States Patent
Pocrass

(10) Patent No.: US 8,357,010 B2
(45) Date of Patent: Jan. 22, 2013

(54) HIGH FREQUENCY LOCAL AND WIDE AREA NETWORKING CONNECTOR WITH INSERTABLE AND REMOVABLE TRANFORMER COMPONENT AND HEAT SINK

(76) Inventor: Alan L. Pocrass, Simi Valley, CA (US)

( * ) Notice: Subject to any disclaimer, the term of this patent is extended or adjusted under 35 U.S.C. 154(b) by 0 days.

(21) Appl. No.: 13/216,319

(22) Filed: Aug. 24, 2011

(65) Prior Publication Data

US 2012/0052718 A1 Mar. 1, 2012

Related U.S. Application Data

(60) Provisional application No. 61/402,242, filed on Aug. 26, 2010.

(51) Int. Cl.
*H01R 13/66* (2006.01)

(52) U.S. Cl. ..... 439/620.22; 439/76.1; 439/676; 439/620.06; 439/620.25; 439/620.23

(58) Field of Classification Search .. 439/620.1–620.25, 439/76.1, 676, 620.06–620.07
See application file for complete search history.

(56) References Cited

U.S. PATENT DOCUMENTS 5,971,805 A * 10/1999 Belopolsky et al. ..... 439/620.17
5,989,069 A * 11/1999 Tan ..... 439/620.23
6,010,367 A * 1/2000 Wu ..... 439/620.23
6,022,245 A * 2/2000 Minich ..... 439/620.17
6,062,908 A * 5/2000 Jones ..... 439/620.07
6,116,946 A * 9/2000 Lewis et al. ..... 439/490
6,132,260 A * 10/2000 Wu ..... 439/676
6,159,050 A * 12/2000 Belopolsky et al. ..... 439/620.23
6,171,151 B1 * 1/2001 Lu et al. ..... 439/620.23
6,179,668 B1 * 1/2001 Kan ..... 439/676
6,234,847 B1 * 5/2001 Chang ..... 439/676
6,238,247 B1 * 5/2001 Belopolsky et al. ..... 439/620.18
6,276,968 B1 * 8/2001 Belopolsky ..... 439/620.18
6,319,064 B1 * 11/2001 Belopolsky et al. ..... 439/620.19
6,328,603 B1 * 12/2001 Chang ..... 439/620.19
6,428,361 B1 * 8/2002 Imschweiler et al. ..... 439/676
6,450,837 B1 * 9/2002 Givens et al. ..... 439/620.19
6,474,999 B1 * 11/2002 Givens et al. ..... 439/76.1
6,511,348 B1 * 1/2003 Wojtacki et al. ..... 439/620.18
6,537,110 B1 * 3/2003 Korsunsky et al. ..... 439/676
6,540,564 B1 * 4/2003 Ko ..... 439/676
6,568,966 B1 * 5/2003 Korsunsky et al. ..... 439/676
6,623,307 B2 * 9/2003 Korsunsky et al. ..... 439/676
6,638,112 B1 * 10/2003 Walker et al. ..... 439/620.19
6,641,440 B1 * 11/2003 Hyland et al. ..... 439/620.17
6,663,437 B2 * 12/2003 Korsunsky et al. ..... 439/676
6,699,065 B1 * 3/2004 Espenshade et al. ..... 439/490
6,702,618 B1 * 3/2004 Hyland et al. ..... 439/620.23
6,709,295 B2 * 3/2004 Givens et al. ..... 439/620.06
6,719,588 B1 * 4/2004 Zheng et al. ..... 439/620.04
6,811,442 B1 * 11/2004 Lien et al. ..... 439/620.07
6,835,098 B1 * 12/2004 Chang ..... 439/620.06
6,840,817 B2 * 1/2005 Chen ..... 439/676

(Continued)

*Primary Examiner* — Ross Gushi
(74) *Attorney, Agent, or Firm* — The Webb Law Firm

(57) ABSTRACT

A network connector includes a housing, an integral printed circuit board in the housing, and a locking mechanism in the housing. The locking mechanism is operative for removably securing an assembled transformer component in operative relation to the integral printed circuit board. Contacts are provided on the integral printed circuit board for contacting contacts of the assembled transformer component when the assembled transformer component is secured in operative relation to the integral printed circuit board. Connector pins extend between a connector in the housing and the integral printed circuit board. Mounting pins extend through the housing from the integral printed circuit board to a position outside the housing for connection to an external printed circuit board. A number of the connectors can be arranged vertically, side-by-side, or both vertically and side-by-side.

10 Claims, 5 Drawing Sheets

U.S. PATENT DOCUMENTS 6,881,096 B2 * 4/2005 Brown et al. ..... 439/620.01
6,916,206 B2 * 7/2005 Ferentz ..... 439/620.01
6,918,790 B2 * 7/2005 Wan et al. ..... 439/620.21
6,918,791 B2 * 7/2005 Wan et al. ..... 439/620.21
6,984,155 B1 * 1/2006 Liu ..... 439/676
6,986,684 B1 * 1/2006 Lien ..... 439/620.07
7,018,242 B2 * 3/2006 Brown et al. ..... 439/676
7,025,635 B2 * 4/2006 Chang ..... 439/620.07
7,040,926 B2 * 5/2006 Ferentz ..... 439/620.21
7,040,927 B1 * 5/2006 Liu ..... 439/620.2
7,044,750 B1 * 5/2006 Lin ..... 439/76.1
7,090,535 B2 * 8/2006 Wan et al. ..... 439/620.01
7,153,158 B1 * 12/2006 Lee ..... 439/541.5
7,153,163 B2 * 12/2006 Lewis et al. ..... 439/620.11
7,314,387 B1 * 1/2008 Liu ..... 439/620.11
7,326,084 B1 * 2/2008 Chen et al. ..... 439/620.23
7,458,856 B2 * 12/2008 Ferentz ..... 439/620.23
7,485,004 B2 * 2/2009 Liu et al. ..... 439/620.25
7,510,441 B2 * 3/2009 Zhang et al. ..... 439/620.18
7,524,206 B2 * 4/2009 Gutierrez et al. ..... 439/607.01
7,611,383 B1 * 11/2009 Huang ..... 439/620.17
7,708,594 B2 * 5/2010 Xu ..... 439/620.05
7,708,595 B2 * 5/2010 Chow et al. ..... 439/620.15
7,736,176 B2 * 6/2010 Zhang et al. ..... 439/541.5
7,833,062 B2 * 11/2010 Zhou et al. ..... 439/620.23
7,837,511 B2 * 11/2010 Hsu ..... 439/669
7,841,902 B2 * 11/2010 Chow et al. ..... 439/620.15
7,841,908 B2 * 11/2010 Shen et al. ..... 439/676
7,896,672 B2 * 3/2011 Felisilda De La Cruz .... 439/188
7,959,473 B2 * 6/2011 Machado et al. ..... 439/676
7,993,163 B2 * 8/2011 Wu et al. ..... 439/620.06
8,038,476 B2 * 10/2011 Chen ..... 439/620.13
8,152,567 B2 * 4/2012 Wu et al. ..... 439/620.06
8,162,695 B2 * 4/2012 Zhang et al. ..... 439/620.22
8,203,853 B2 * 6/2012 Chen ..... 361/811
8,206,183 B2 * 6/2012 Machado et al. ..... 439/676
8,246,389 B2 * 8/2012 Zhang et al. ..... 439/676
2002/0019174 A1 * 2/2002 Crane et al. ..... 439/676
2002/0155758 A1 * 10/2002 Wang ..... 439/620
2003/0077942 A1 * 4/2003 Givens et al. ..... 439/620
2003/0207621 A1 * 11/2003 Gutierrez et al. ..... 439/676
2003/0211782 A1 * 11/2003 Esparaz et al. ..... 439/620
2004/0209522 A1 * 10/2004 Chang ..... 439/676
2004/0242077 A1 * 12/2004 Chang ..... 439/676
2004/0253849 A1 * 12/2004 Kuribayashi et al. ..... 439/76.1
2005/0009409 A1 * 1/2005 Chen ..... 439/676
2006/0068615 A1 * 3/2006 Pirner et al. ..... 439/76.1
2007/0015416 A1 * 1/2007 Gutierrez et al. ..... 439/676
2008/0214052 A1 * 9/2008 Li ..... 439/620.21
2008/0305680 A1 * 12/2008 Little et al. ..... 439/541.5
2008/0305692 A1 * 12/2008 Little et al. ..... 439/676
2009/0081907 A1 * 3/2009 Shen et al. ..... 439/676
2009/0186526 A1 * 7/2009 Xu ..... 439/620.22
2009/0253299 A1 * 10/2009 Zhang et al. ..... 439/607.55
2009/0298340 A1 * 12/2009 Li ..... 439/620.22
2010/0015859 A1 * 1/2010 Slepov ..... 439/676
2010/0255726 A1 * 10/2010 Huang et al. ..... 439/607.01
2010/0297882 A1 * 11/2010 Wu et al. ..... 439/620.07
2011/0039451 A1 * 2/2011 Tung ..... 439/620.23
2011/0111620 A1 * 5/2011 Lee et al. ..... 439/488
2011/0124237 A1 * 5/2011 Chung ..... 439/676
2011/0151717 A1 * 6/2011 Ge et al. ..... 439/620.07
2011/0256770 A1 * 10/2011 Opitz et al. ..... 439/620.15
2011/0268112 A1 * 11/2011 Slepov ..... 370/389
2011/0300765 A1 * 12/2011 Kobayashi et al. ..... 439/676
2012/0052718 A1 * 3/2012 Pocrass ..... 439/485
2012/0071011 A1 * 3/2012 Kagan et al. ..... 439/76.1

* cited by examiner

HIGH FREQUENCY LOCAL AND WIDE AREA NETWORKING CONNECTOR WITH INSERTABLE AND REMOVABLE TRANFORMER COMPONENT AND HEAT SINK

CROSS REFERENCE TO RELATED APPLICATION

This application claims priority from U.S. Provisional Patent Application No. 61/402,242, filed Aug. 26, 2010, which is incorporated herein by reference.

BACKGROUND OF THE INVENTION

1. Field of the Invention

The present invention is a connector with an integral printed circuit board (PCB) and with an insertable and removable assembled transformer component configured for local area and wide area network communications.

2. Description of Related Art

It is well known in the art of personal computers and other such intelligent, processor based electronic devices to use Ethernet connectors to facilitate a wired connection to a computer network operating utilizing the well known Ethernet communication protocol. These connectors are typically coupled to printed circuit boards inside the personal computers and include a female RJ45 connector for coupling with a male RJ45 connector at one end of a cable, the other end of which is coupled to a network connection point that facilitates network traffic on the network cable.

These network connectors often include so-called magnetic components permanently installed therein. These magnetic components are operative to process and condition communication signals passing through the connectors. A problem with these prior art connectors, however, is that if any of the magnetic components fail, it becomes necessary to either replace the entire connector with a new connector with working magnetic components (by, for example, unsoldering the old connector from the circuit board and soldering the new connector to the circuit board) and/or by replacing the entire circuit board on which the connector is connected with a new circuit board.

SUMMARY OF THE INVENTION

The present invention is a network connector comprising: a housing; an integral printed circuit board in the housing; a locking mechanism in the housing, said locking mechanism operative for removably securing an assembled transformer component in operative relation to the integral printed circuit board; contacts on the integral printed circuit board for contacting contacts of the assembled transformer component when the assembled transformer component is secured in operative relation to the integral printed circuit board; connector pins extending between a connector in the housing and the integral printed circuit board; and mounting pins extending through the housing from the integral printed circuit board to a position outside the housing for connection to an external printed circuit board.

The network can further include conductive shielding on at least part of the housing and at least one pin coupled to the shielding for connection to the external printed circuit board.

The network connector can further include a heat sink coupled to the housing or the assembled transformer component secured in operative relation with the integral printed circuit board.

The locking mechanism can include a frame inside the housing, said frame having one or more lock springs for securing the assembled transformer component in operative relation with the integral printed circuit board.

The network connector can further include conductive traces on the integral printed circuit board for electrical connection to one or more of the following: one or more of the connector pins; one or more of mounting pins; and one or more contacts of the assembled transformer component.

The assembled transformer component can include one or more of the following components mounted on a printed circuit board of the assembled transformer component: one or more integrated circuit components; one or more resistors; one or more capacitors; one or more chokes; or one or more transformers. The one or more components of the assembled transformer component desirably facilitate the transmission of network signals from an upstream network signal source to a downstream network signal receiver via the connector pins and the mounting pins.

The connector can be an RJ45 female connector.

The network connector can further include a plurality of the above-described connectors arranged vertically, side-by-side, or both vertically and side-by-side.

The network connector can include between 4 and 10 of the connector pins.

DETAILED DESCRIPTION OF THE INVENTION

Figure 1:
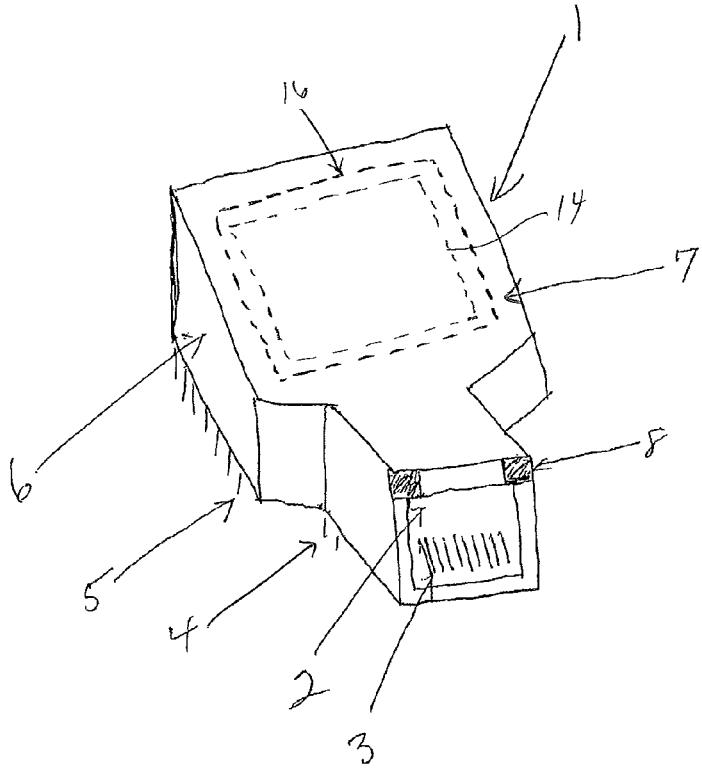
FIG. 1 is a perspective view of an assembled connector in accordance with the present invention that includes an integral PCB and an insertable and removable assembled transformer component.

The present invention is a connector that includes a housing with an integral printed circuit board (PCB), an assembled transformer component that can be mounted onto and removed from the integral PCB, a locking mechanism to secure the assembled transformer component to the integral PCB, optional external conductive shielding, contact pins, contact pads, and an optional heat sink. The assembled transformer component can include one or more of the following mounted on a PCB of the assembled transformer component: one or more integrated circuit components, such as, without limitation, a microcontroller Ethernet chip, resistor(s), capacitor(s), choke(s), and/or transformer(s). The integral PCB and the PCB of the assembled transformer component are different PCBs.

In use, the assembled transformer component mounted on the integral PCB disposed in the connector housing receives Ethernet signals from an upstream signal source via a connector (e.g., without limitation, a female RJ45 connector, or mounting pins of the connector), increases the level of the received Ethernet signals, and then dispatches the increased level Ethernet signals to a downstream signal receiver. If the assembled transformer component includes a microcontroller Ethernet chip, said chip can decode and then encode data modulated on the Ethernet signals to facilitate the successful recovery of the data by the downstream receiver. Generally, the assembled transformer component, either with or without the microcontroller Ethernet chip, operates in the nature of a repeater. The disclosure herein of the microcontroller Ethernet chip and Ethernet signals is not to be construed as limiting the invention since it is envisioned the present invention can be adapted for use with any suitable and/or desirable communication protocol.

The present invention enables the assembled transformer component, with or without the microcontroller Ethernet chip, to be inserted and removed from the housing. Where the assembled transformer component includes the microcontroller Ethernet chip, the ability to insert and remove the assembled transformer component facilitates the use of assembled transformer components that include microcontroller Ethernet chips manufactured by any suitable and/or desirable chip manufacturer. An advantage of the connector of the present invention is that if the microcontroller Ethernet chip (or any other component mounted on the assembled transformer component) fails, the assembled transformer component can be replaced with another assembled transformer component with functioning components.

Desirably, the connector of the present invention includes external shielding on at least part of the connector housing to avoid internally generated electromagnetic interference (EMI) from exiting the housing or externally generated EMI from entering the housing thereby potentially interfering with the operation of the assembled transformer component. The connector of the present invention finds particular application in high speed Ethernet communications. However, this is not to be construed as limiting the invention. Desirably, the connector of the present invention has a housing large enough to accommodate the assembled transformer component supporting all of the components required for 10 GB, 1 GB and 10/100 Mbps transmission speeds.

Heretofore, the component(s) supported by the assembled transformer component of the connector of the present invention were not part of an insertable and removable assembled component. With the present invention, the assembled transformer component, which can be manufactured by any suitable and/or desirable manufacturer, can be mounted on the integral PCB inside the connector of the present invention and secured in place on said integral PCB via a locking mechanism. The connector of the present invention can include conductive (e.g., metal) shielding on at least part of the outside of the housing to avoid electromagnetic interference from exiting the housing and/or to shield the integral PCB with the assembled transformer component mounted thereon from externally generated electromagnetic interference.

The present invention includes a locking mechanism for securing the assembled transformer component in operative relation to the integral PCB of the connector, with conductive pins or pads of the assembled transformer component in contact with conductive pads of the integral PCB of the connector that in-turn are in contact, via traces on said integral PCB, with mounting pins that extend through the housing to the outside of the housing for mounting to an external PCB. The conductive pins or pads of the assembled transformer component, the conductive pads of the integral PCB, and the traces on the integral PCB are desirably surrounded by the conductive shielding on the outside of the housing to shield them from externally generated electromagnetic interference.

Desirably, the connector of the present invention, including the assembled transformer component, is compatible with all past and current 10 Gigabit Ethernet or 10 GbE or 10 GigE standards, such as, without limitation: IEEE Standards 802.3ae-2002, 802.3ae-2002 (fiber -SR, -LR, -ER and -LX4 PMDs), 802.3ak-2004, 802.3an-2006 (10GBASE-T copper twisted pair), 802.3ap-2007 (copper backplane -KR and -KX4 PMDs), 802.3aq-2006 (fiber—LRM PMD with enhanced equalization); and the 802.3ae-2002 and 802.3ak-2004 amendments which have been consolidated into the IEEE 802.3-2005 standard.

The assembled transformer component includes components that facilitate the transfer of electrical energy from one circuit to another through inductively coupled electrical conductors or transformers of the assembled transformer component. This transfer of electrical energy is based on two principles: (1) that an electric current can produce a magnetic field and (2) that a changing magnetic field within a coil of wire induces a voltage across the ends of the coil by way of electromagnetic induction. Changing current in a primary wire or coil, changes the strength of the magnetic field around the primary coil or wire. Since this changing magnetic field extends into the secondary wire or coil, a voltage is also induced across the secondary wire or coil.

The connector of the invention includes a locking mechanism for securing the assembled transformer component to the integral PCB whereupon the pins or pads of the assembled transformer component make contact with conductive pads or insert, in a press fit manner into through-holes on the integral PCB. Once the assembled transformer component is coupled in operative relation to the integral PCB of the connector, the assembled transformer component increases the level of a signal received from an upstream signal source before transmitting the increased level signal to a downstream receiver.

The assembled transformer component can include one or more transformers and/or electromagnetic coils, a.k.a., common mode choke coils. A choke coil is formed using a conductive wire which is wound around a core or form to create an inductor or electromagnet. One loop of wire is usually referred to as a turn, and each coil includes one or more turns. Each coil includes external electrical connection terminals called taps and is coated with varnish and/or wrapped with insulating tape to provide additional insulation. Coil taps are points in a wire coil where a conductive path has been exposed. This is a loop of wire that extends out of the main coil body. A completed coil assembly with taps is often called a winding.

A transformer is an electromagnetic device that has a primary winding and a secondary winding that transfers energy from one electrical circuit to another by magnetic coupling without moving parts. A tickler coil usually refers to a third coil placed in relation to the primary coil and the secondary coil.

The connector of the present invention includes one or more of these components (which can be made by many companies known in the industry) on the assembled transformer component. The nature of the manufacturing of the assembled transformer component is for the pins or taps of the components thereof to be coupled to the PCB of the assembled transformer component by different means including, without limitation, surface mount assembly and through-hole assembly. It should be appreciated that the PCB of the assembled transformer component is different than the integral PCB of the connector to which the assembled transformer component can be mounted in operative relation. Each component mounted on the PCB of the assembled transformer component can include a synthetic resin or other protective material enclosing the component.

The connector of the present invention operates with 10 GB, 1 GB and 10/100 Mbps Ethernet networking and is commonly known as a "magnetic connector". Existing magnetic connectors do not have an insertable and/or removable assembled transformer component and locking mechanism for use with assembled transformer components manufactured by different vendors. Moreover, these existing magnetic connectors cannot handle high frequencies and the high number of pins required to perform the function of the connector of the present invention.

One or more components of the assembled transformer component of the connector of the present invention can emit undesirable amounts of heat. To facilitate the removal of this heat, an optional integrated heat sink can be disposed in contact with the connector housing or an exposed side of the assembled transformer component mounted in operative relation on the integral PCB of the connector, e.g., the heat sink can be in contact with the side of the assembled transformer component opposite the integral PCB of the housing. This heat sink facilitates the transfer and dissipation of heat generated by the components of the assembled transformer component. Existing connectors do not include such an integral heat sink. The heat sink in the present invention is optional and is not required if the assembled transformer component does not emit excessive heat.

The connector of the present invention desirably includes an insertable and removable assembled transformer component and an RJ45 connector, e.g., an RJ45 female connector or receptacle, that has connector pins that are connected to traces on the integral PCB. The connector of the present invention can be, but is not necessarily, wider than existing connectors that have RJ45 connectors and which have permanently installed transformer components integrated therein without a means to remove and replace said transformer components. The RJ45 connector part of the connector of the present invention desirably has between 4-10 connector pins to facilitate the connector of the present invention being compatible and useable with 10 GB, 1 GB and 10/100 Mbps Ethernet signals. Existing RJ45 connectors typically have no more than 8 contact pins. The integral PCB of the connector of the present invention can include multiple layers that facilitate routing of PCB traces from the components mounted thereon to connector pins of the RJ45 female connector part of the connector of the present invention that mate with connector pins of an RJ45 male plug inserted into the RJ45 female connector part of the connector of the present invention. The connector of the present invention can include mounting pins which extend through the housing from the integral PCB to an exterior of the connector to be soldered or attached to an external PCB.

The connector of the present invention can be used with high speed network communications, e.g., without limitation, 10 GB Ethernet communications.

The invention will now be described with reference to the accompanying figures where like reference numbers correspond to like elements.

Figure 2:
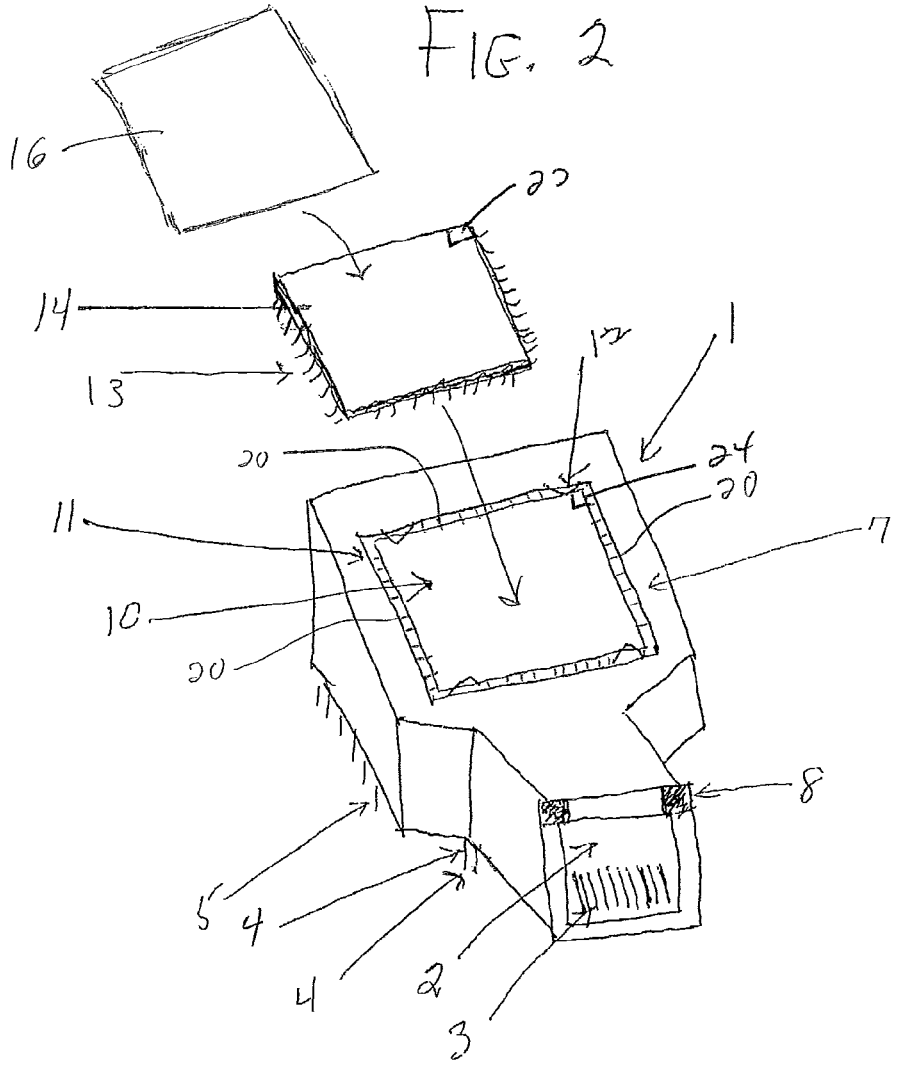
FIG. 2 is a partially exploded perspective view of the connector of FIG. 1 showing the integral PCB inside the connector of FIG. 1 with a locking mechanism and with the assembled transformer component and top shielding spaced from the RJ connector.
Figure 4:
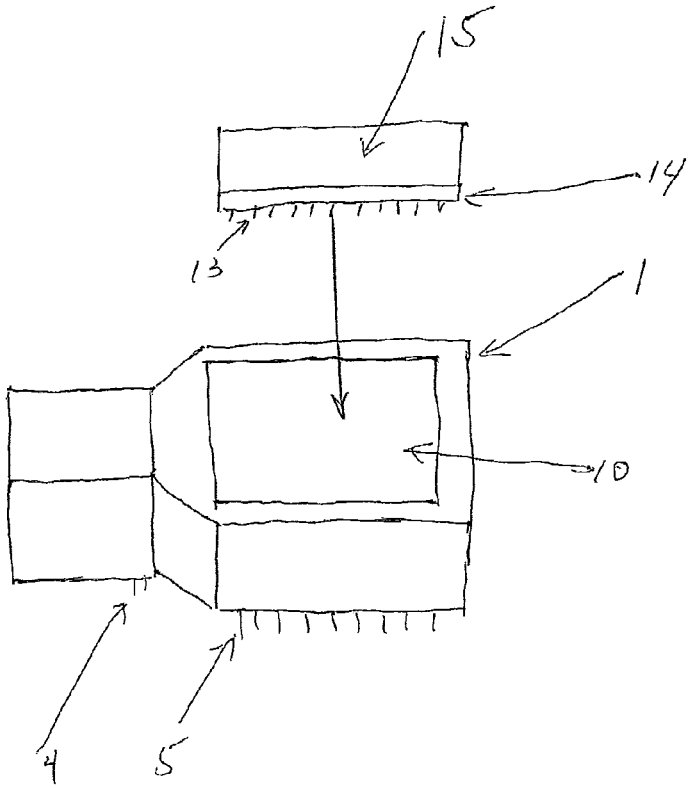
FIG. 4 is a partially exploded side perspective view of the connector of FIG. 1 showing the assembled transformer component coupled to an optional heat sink positioned spaced from the integral PCB.

FIGS. 1 and 2 are an embodiment of an RJ45 connector 1 in accordance with the present invention comprising an integrated pre-assembled transformer component 14, an integral printed circuit board (PCB) 10 (FIG. 2), and a locking mechanism 12 (FIG. 2) for assembled transformer component 14 to be inserted and removed. FIG. 1 is a perspective view of connector 1 showing a housing 7, metal shielding 6 surrounding at least part of housing 7, a cavity opening 2, in the form of an RJ45 female receptacle, for insertion of a male RJ45 plug (not shown), connector pins 3 of opening 2, LED pins 4 for coupling to internal LEDs 8 of housing 7 via integral (PCB) 10, and mounting pins 5 that extend from integral printed circuit board 10 through the bottom of housing 7 for coupling to an external printed circuit board (not shown). The illustrated embodiment is a 10 Gigabit Ethernet local area networking RJ45 connector with insertable and removable assembled transformer component 14 and optional heat sink (FIG. 4). However, this is not to be construed as limiting the invention.

FIG. 2 is a partially exploded perspective view of connector 1 shown in FIG. 1 showing the inside of connector 1 with the assembled transformer component 14 spaced from the housing 7 and integral PCB 10 with pins or pads 13 of assembled transformer component 14 prior to insertion into connector 1. The assembled transformer component 14 and the pins or pads 13 insert into an opening in connector 1 with pins or pads 13 in contact with pads 20 on integral printed circuit board 10 and lock in place with via metal springs 12 of the locking mechanism. The metal springs 12 of locking mechanism, coupled to housing 7 and/or integral PCB 10, are configured and arranged to apply a spring force to assembled transformer component 14 that urges the pins or pads 13 of assembled transformer component 14 into contact with the pads 20 of integral PCB 10. The opening in connector 1 is sized to avoid lateral movement of assembled transformer component 14 in contact with integral PCB 10 via said opening.

The pins or pads 13 of assembled transformer component 14 align with pads 20 on integral printed circuit board 10. Pins or pads 13 of assembled transformer component 14 extend and contact pads 20 on printed circuit board 10 when assembled transformer component 14 is inserted into the opening of housing 7 in operative contact with integral PCB 10. Desirably, assembled transformer component 14 includes an alignment slot or projection 22 that aligns with a mating alignment projection or slot 24 of housing 7 or integral PCB 10 to avoid mis-alignment of assembled transformer component 14 when inserted into the opening in housing 7 in operative relation to integral PCB 7.

Mounting pins 5 electrically connect to integral printed circuit board 10. Connector pins 3 and the mounting pins 5 make electrical connection through traces on integral printed circuit board 10 with the pins or pads 13 of assembled transformer component 14 when said assembled transformer component 14 is inserted into the opening in connector 1 into operative relation with integral PCB 10. The number of pins or pads 13 can vary based on the capabilities of semiconductor companies who manufacture assembled transformer components 14.

The locking mechanism includes a frame 11 and locking metal or plastic springs 12. Shielding 6 includes a top removable shield section 16 on the top side of connector 1. This removable shield section 16 can be removed to expose the inside of connector 1 to facilitate easy removal or insertion of assembled transformer component 14.

Figure 3:
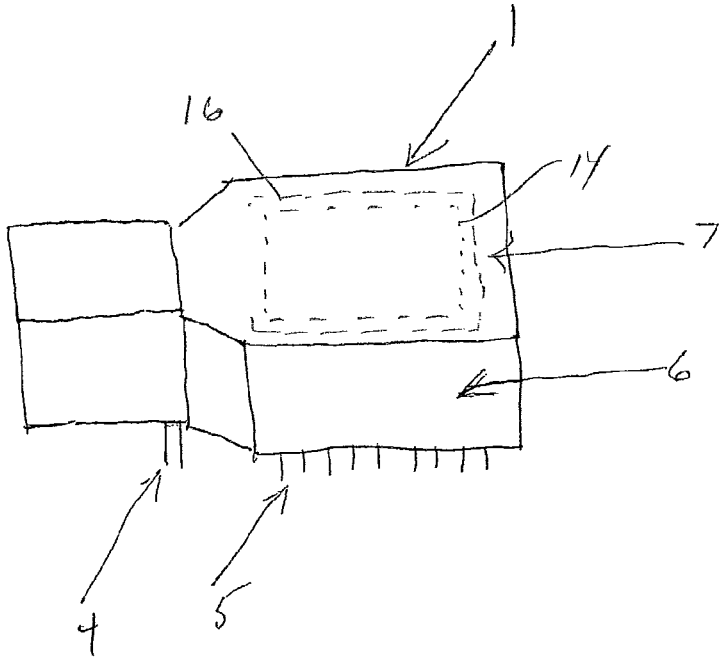
FIG. 3 is a side perspective view of the assembled connector of FIG. 1.

FIG. 3 is a side view of connector 1 with the shielding 16 attached.

Figure 4A:
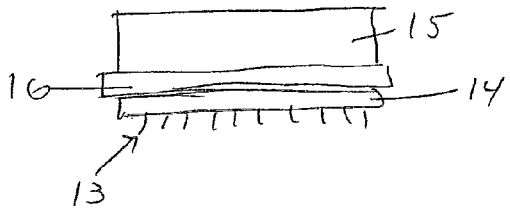
FIG. 4A is a side view of the top shielding sandwiched between the assembled transformer component and the optional heat sink of FIG. 4.

FIG. 4 is a side view of connector 1 with shielding 16 omitted exposing integral printed circuit board 10 with the assembled transformer 14 and optional heat sink 15 external to connector 1 before they are inserted. In FIG. 4, optional heat sink 15 replaces shielding 16 over assembled transformer component 14. Alternatively, as shown in FIG. 4A, shielding 16 can be sandwiched between assembled transformer component 14 and heat sink 15.

Figure 5:
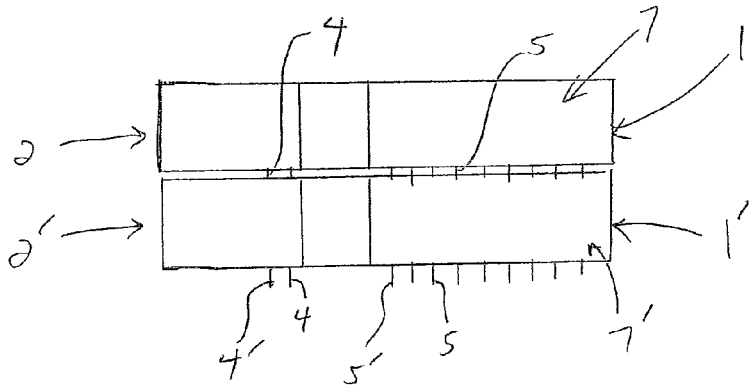
FIG. 5 is a side view of 1×2 vertical array of connectors in accordance with the present invention.

FIG. 5 is a side view of a 1×2 vertical array of connectors 1 of the type discussed above. In FIG. 5, mounting pins 5 of top connector 1 extend through housing 7' of lower connector 1' and project out of the bottom of said housing 7' adjacent mounting pins 5' of lower connector 1'. Alternatively, the extensions of mounting pins 5 of top connector 1 in lower connector 1' can include receiving apertures that receive the distal ends of pins 5 of top connector 1 in a press fit manner that facilitates the coupling and uncoupling of top connector 1 to and from bottom connector 1' in the manner of a pin grid array utilized to insert and remove integrated circuits from PCBs. In this embodiment lower connector 1' includes in the housing 7' thereof the extensions of pins 5 of top connector 1. Thus, if top connector 1 is not mated with lower connector 1', these extensions of pins 5 are not used electrically. Similarly, pins 4 of the upper connector 1 shown in FIG. 5 can extend through housing 7' of lower connector 1' and project outside of housing 7' of lower connector 1' parallel to pins 4 of lower connector 1. Alternatively, the distal ends of pins 4 can be received in a press fit manner in receiving apertures of the extensions of pins 4 in lower connector 1' in the manner of a pin grid array utilized to insert and remove integrated circuits from PCBs.

Figure 6:
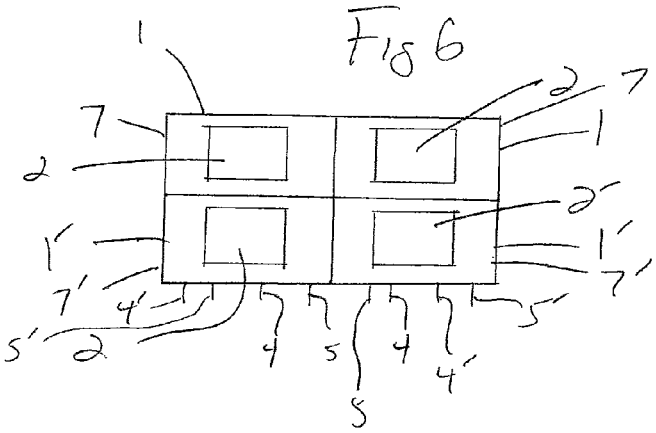
FIG. 6 is an end view of a 2×2 array of connectors in accordance with the present invention.

FIG. 6 is an end view of a 2×2 array of connectors of the type discussed above. In the embodiment shown in FIG. 6, all of the pins 4, 4', 5, and 5' extend from the lower surface of the 2×2 array of connectors 1, with the pins 4 and 5 of each upper connector 1 extending through the housing 7' of the lower connector 1' aligned therewith either directly or via extensions of pins 4 and 5 of each top connector 1' through the bottom connector 1' aligned therewith in the manner of a pin grid array utilized to insert and remove integrated circuits from PCBs. For example, pins 4 and 5 of the upper left connector 1 project through the housing 7' of the lower left connector 1, and pins 4 and 5 of the upper right connector 1 project through the housing 7' of the lower right connector 1'. Desirably, in the embodiments shown in FIGS. 5 and 6, each upper connector 1 is removably mounted to the connector 1' immediately therebelow, i.e., in the same manner that a pin grid array of an integrated circuit is utilized to removably couple the integrated circuit to a PCB, to facilitate access to the opening in each connector 1 for removal and replacement of the assembled transformer component 14.

The present invention has been described with reference to exemplary embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A network connector comprising:

a housing;

an integral printed circuit board in the housing;

a locking mechanism in the housing, said locking mechanism operative for removably securing an assembled transformer component in operative relation to the integral printed circuit board;

contacts on the integral printed circuit board for contacting contacts of the assembled transformer component when the assembled transformer component is secured in operative relation to the integral printed circuit board;

connector pins extending between a connector in the housing and the integral printed circuit board; and mounting pins extending through the housing from the integral printed circuit board to a position outside the housing for connection to an external printed circuit board.

2. The network connector of claim 1, further including conductive shielding on at least part of the housing and at least one pin coupled to the shielding for connection to the external printed circuit board.

3. The network connector of claim 1, further including a heat sink coupled to the housing or assembled transformer component secured in operative relation with the integral printed circuit board.

4. The network connector of claim 1, wherein the locking mechanism includes a frame inside the housing, said frame having one or more lock springs for securing the assembled transformer component in operative relation with the integral printed circuit board.

5. The network connector of claim 1, further including conductive traces on the integral printed circuit board for electrical connection to one or more of the following:

one or more of the connector pins;

one or more of mounting pins; and one or more contacts of the assembled transformer component.

6. The network connector of claim 1, wherein the assembled transformer component includes one or more of the following components mounted on a printed circuit board of the assembled transformer component:

one or more integrated circuit components;

one or more resistors;

one or more capacitors;

one or more chokes; and one or more transformers.

7. The network connector of claim 6, wherein the one or more components of the assembled transformer component facilitate the transmission of network signals from an upstream network signal source to a downstream network signal receiver via the connector pins and the mounting pins.

8. The network connector of claim 1, wherein the connector is an RJ45 female connector.

9. The network connector of claim 1, further comprising a plurality of the connectors of claim 1 arranged vertically, side-by-side, or both vertically and side-by-side.

10. The network connector of claim 1, including between 4 and 10 connector pins.

* * * * *

UNITED STATES PATENT AND TRADEMARK OFFICE

CERTIFICATE OF CORRECTION

PATENT NO. : 8,357,010 B2
APPLICATION NO. : 13/216319
DATED : January 22, 2013
INVENTOR(S) : Alan L. Pocrass It is certified that error appears in the above-identified patent and that said Letters Patent is hereby corrected as shown below:

Title Page, Column 1, Item (54), Line 4, and in the specification, column 1, line 4, delete "TRANFORMER" and insert -- TRANSFORMER --

Signed and Sealed this
Second Day of April, 2013

Teresa Stanek Rea
*Acting Director of the United States Patent and Trademark Office*